United States Patent [19]

Marotto et al.

[11] Patent Number: 4,671,549

[45] Date of Patent: Jun. 9, 1987

[54] TUBULAR AUTOMATIC DEADBOLT LATCH

[75] Inventors: Robert A. Marotto; Vincent M. Kemp; Henry A. Holmes, Jr., all of Auburn, Ala.

[73] Assignee: Dexter Lock Company, Auburn, Ala.

[21] Appl. No.: 759,223

[22] Filed: Jul. 26, 1985

[51] Int. Cl.[4] ..... E05C 1/16

[52] U.S. Cl. ..... 292/333; 292/192

[58] Field of Search ..... 292/191, 192, 333, 335, 292/244

[56] References Cited

U.S. PATENT DOCUMENTS

| | | | |
|---|---|---|---|
| 1,302,873 | 5/1919 | Stiff | 292/335 |
| 2,015,248 | 9/1935 | Williams | 292/335 X |
| 2,142,456 | 1/1939 | Oldham | 292/335 |
| 2,723,873 | 11/1955 | Schlage | 292/335 |
| 4,061,383 | 12/1977 | Waldo | 292/335 |
| 4,262,504 | 4/1981 | Inoue | 70/151 R |

FOREIGN PATENT DOCUMENTS

| | | | |
|---|---|---|---|
| 629235 | 4/1936 | Fed. Rep. of Germany . | |
| 1016319 | 8/1952 | France | 292/335 |

*Primary Examiner*—Richard E. Moore

*Attorney, Agent, or Firm*—Pennie & Edmonds

[57] ABSTRACT

An automatic tubular deadbolt lock assembly having the automatic actuator mechanism enclosed within the tubular housing of the lock. The assembly is dimensioned like a standard tubular deadbolt, to fit within standard borings of present doors. A special quadrant trigger is mounted in and protrudes from the nose of the deadbolt, being pivotal into the deadbolt itself to an inactive recessed position upon opening of the door. With closure of the door, the trigger is cammed and depresses a camming plunger to release a transverse locking pin from engagement with the tubular lock housing, to thereby allow biased extension of the deadbolt from its retracted condition. The trigger can be rotationally reversed to accommodate left hand or right hand door arrangements.

15 Claims, 10 Drawing Figures

TUBULAR AUTOMATIC DEADBOLT LATCH

BACKGROUND OF THE INVENTION

This invention relates to door lock deadbolt mechanisms, and particularly to a tubular door lock having an automatically actuated deadbolt upon closure of the door.

The concept of a locking safety bolt, typically called a deadbolt, actuated automatically with closure of the door, has been employed in prior teachings. In U.S. Pat. No. 1,816,134 to Wood, for example, is disclosed a mortise type lock having an automatic deadbolt mechanism. Mortise type locks employ a large amount of space, require special forming of the lock-receiving cavity in the door, and are rarely employed anymore. Tubular locks have generally replaced mortise locks in the last several decades. Wood and metal doors are made and bored to receive the standard tubular locks.

In U.S. Pat. No. 4,561,684 entitled AUTOMATIC DEADBOLT by one of the applicants herein and assigned to the assignee herein is disclosed a tubular lock assembly specially built to achieve automatic deadbolt actuation. Such a structure works effectively. However, it does require special work on each door to enable the lock assembly to be fitted into place. Performing such installation work on wood doors takes special efforts by the lock installer. Moreover, modification of steel doors to accept the lock of that application is more complicated, being effectively done at the door manufacturing stage. This requires persuasion of the door manufacturer to change its standard door construction to accommodate the special lock. Unfortunately, door manufacturers and hardware installing builders tend to be reluctant to alter standard products and techniques.

SUMMARY OF THE INVENTION

The present invention embodies a unique tubular lock assembly wherein an automatic deadbolt mechanism is completely incorporated within the tubular case housing itself. The automatic deadbolt tubular lock has exterior dimensions the same as the standard tubular lock which is now widely used. Installation is therefore readily achieved without altering the standard door structure, wood or steel, from that presently employed. The lock accommodates all standard face plate variations including rectangular face plates, one-quarter inch round face plates, and drive-in face plates. Moreover, the novel lock can be directly retrofitted into existing doors in place of the standard tubular lock simply by removal of the standard lock and substituting the novel structure. No unusual tools are required. No special skills are necessary.

The novel tubular lock employs a special quadrant trigger protruding from the nose of the deadbolt itself, and recessible into the deadbolt. It triggers release of the cocked retracted deadbolt to cause the latter to automatically extend into the standard strike plate on a door jamb with closure of the door. Yet, it is so constructed that, with the deadbolt retracted and the door being opened, the trigger will shift without triggering release of the deadbolt.

Moreover, the trigger can be easily converted to accommodate left hand or right hand doors, by reversing it due to its special structure.

The novel structure has a relatively small number of components achieving the beneficial results, and is capable of production with substantially low initial cost of forming dies.

These and other features and advantages will become apparent upon studying the following specification in conjunction with the drawings.

DESCRIPTION OF THE PREFERRED EMBODIMENT

Figure 8:
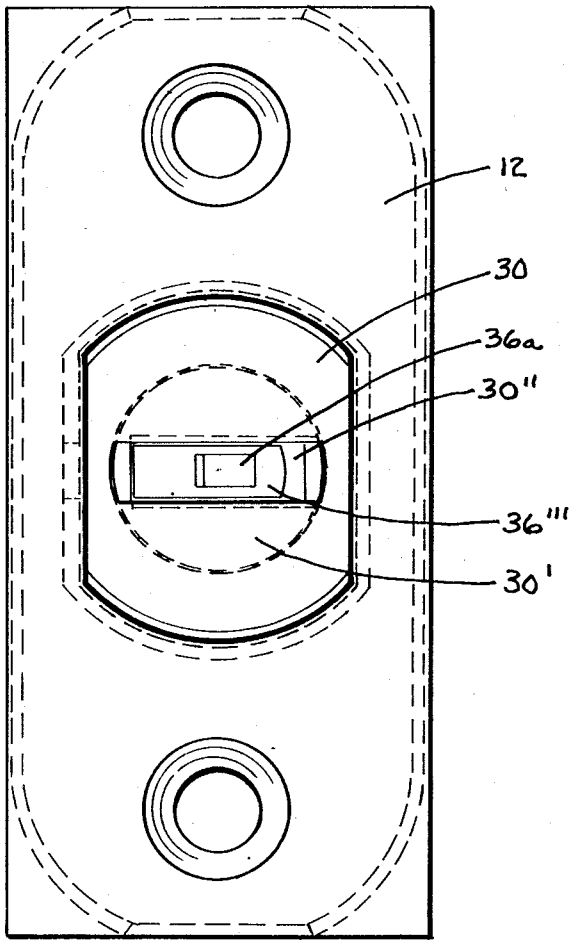
FIG. 8 is an end elevational view of the lock with the deadbolt retracted and the trigger being pivotally shifted to a recessed condition within the deadbolt as occurs during opening of the door.
Figure 1:
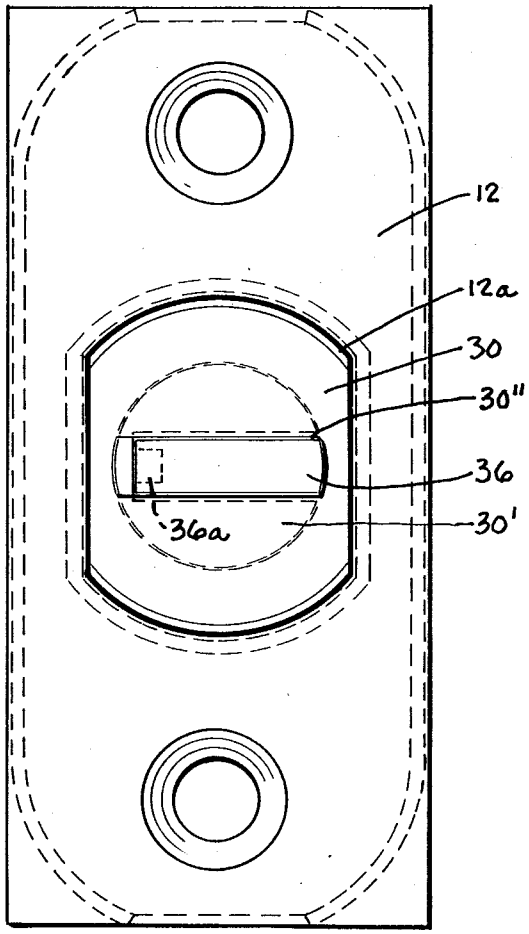
FIG. 1 is an end elevational view of the novel lock structure shown using a standard rectangular face plate.
Figure 2:
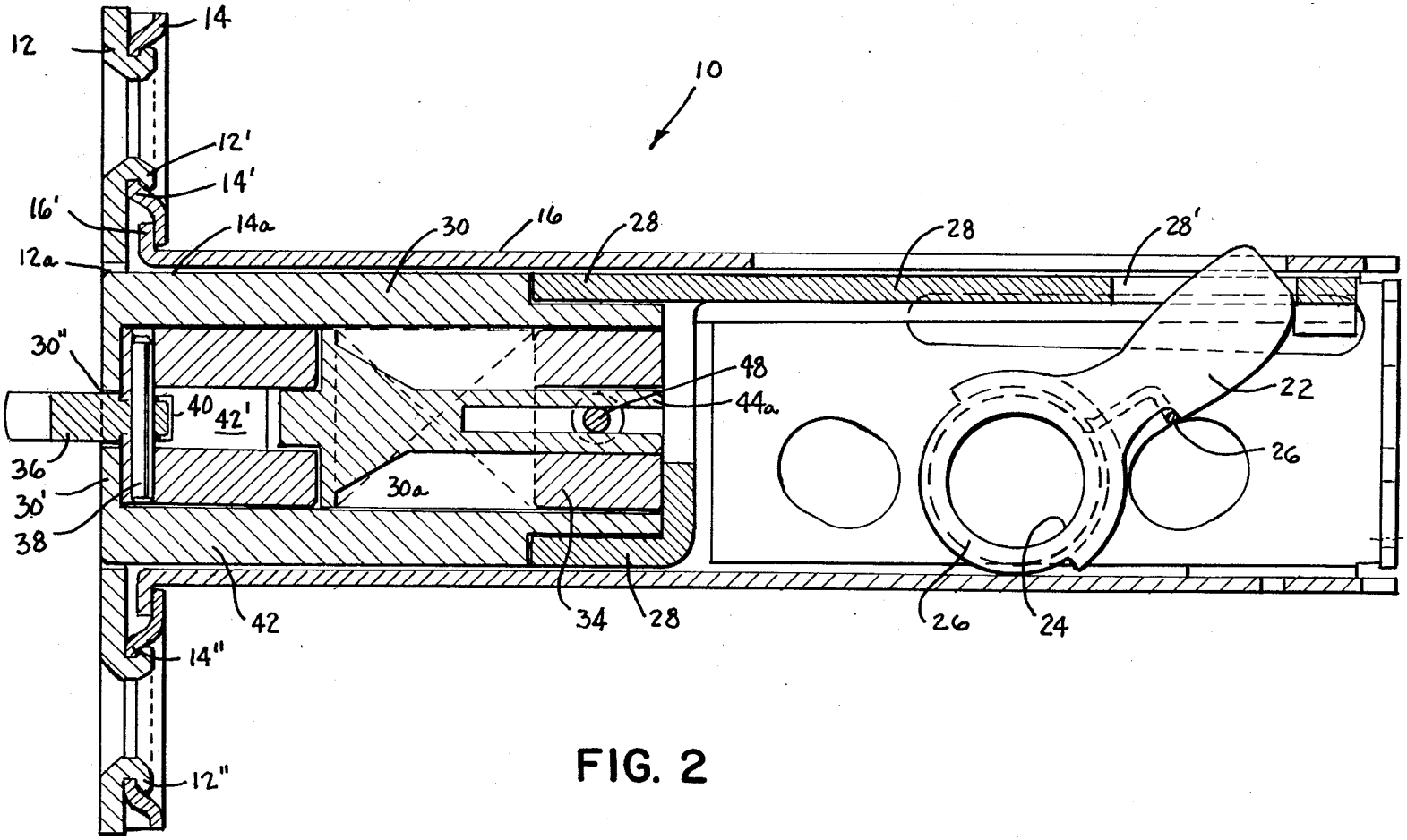
FIG. 2 is a side elevational sectional view taken on plane A—A of FIG. 1, showing the deadbolt in the retracted position.
Figure 3:
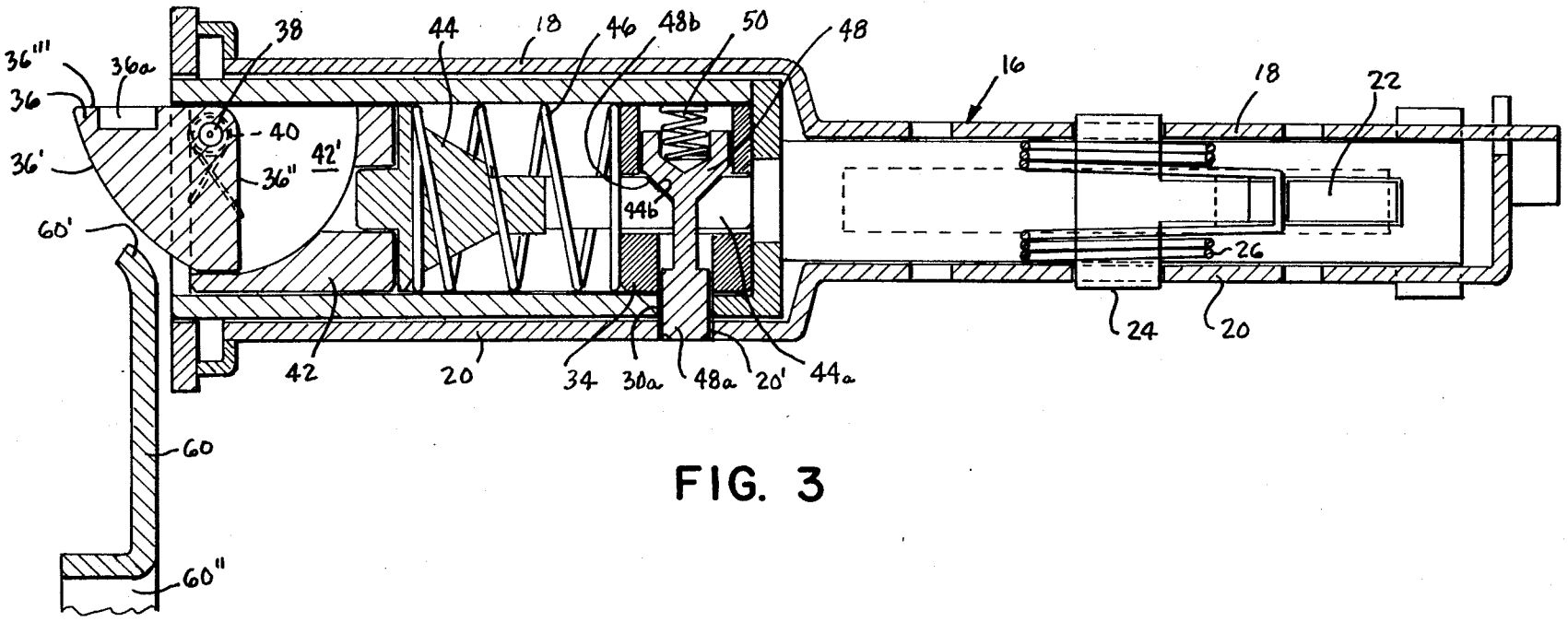
FIG. 3 is a sectional view taken on plane B—B of FIG. 1, showing the deadbolt in the retracted position.

Referring now specifically to the drawings, and initially to FIGS. 1-3, the novel tubular deadbolt lock assembly is there shown with the deadbolt in the retracted position, and employing conventional rectangular face plates. More specifically, the assembly 10 is shown to include interconnected front face plate 12 and rear face plate 14 to which is mounted the tubular housing 16 composed of the typical left case half 18 and right case half 20 (FIG. 3). Front plate 12 is connected to back plate 14 as by an upper swaged annular collar 12' over a corresponding annular collar 14' of the back plate, and a lower swaged collar 12" over cooperative rear collar 14" of the back plate. These also define a pair of openings for fasteners such as screws (not shown) to be threadably secured into the edge of a conventional door for mounting the lock assembly. These two face plates define an opening through which the deadbolt can extend, specifically the opening formed by the front plate opening **12*a* and the rear plate opening 14*a*. The outer end of tubular housing 16 also extends through opening 14*a*, including an annular flange 16' extending radially outwardly into the space formed between the front and back plates in conventional fashion. In this embodiment depicted, these face plates, and particularly front plate 12**, define the front face of the lock at the edge of the door. If a round cornered face plate or a drive in face plate is used instead, they would define the front face.

Within housing 16 at the inner end portion thereof is a conventional pivotal swivel 22 shiftable from its retracted position (FIGS. 2 and 3) to its extended position (FIGS. 6 and 7) on its pivot sleeve 24. The sleeve receives the shaft (not shown) of a conventional thumb turn (on the inside of the door) and key and cylinder lock (on the outside of the door) in conventional fashion. Shifting of this swivel from the extended position to the retracted position is achieved by rotating the standard key and cylinder unit (not shown) or turn unit (not shown). Pivoting of the swivel to the left or the right (as viewed) causes extension or retraction respectively of the bolt body 28 by engagement of the radially extending swivel 22 with the ends of slot 28' in the bolt body. The forward end of bolt body 28 is secured to the bolt 30 itself so that these two components (bolt body and bolt) act as one in the forward and rearward movements, i.e. extension and retraction of the bolt. Torsion spring 26 around sleeve 24 engages swivel 22 to bias it toward the extended position.

Within the deadbolt itself is the unique automatic actuation assembly. More specifically, the deadbolt includes an elongated hollow interior space **30*a* closed at the inner or rear end by an annular locking pin housing 34, and generally closed at the outer or forward end by the integral face flange 30', except for a rectangular shaped slot 30'' through which the bolt trigger 36 extends. This bolt trigger is pivotally mounted on a pivot pin 38. Pin 38 is mounted in trigger housing 42, with both being inside the deadbolt. Around the pin is a torsion spring 40 biasing the pivotal trigger toward its extended position illustrated in FIGS. 2 and 3. This trigger is in the configuration of a quadrant, having a front arcuate camming surface 36', a flat radial inner surface 36'', and a flat radial rear surface 36''', these flat surfaces forming the two radial legs of the quadrant. The pivotal axis is adjacent the apex of the quadrant. Arcuate camming surface 36' is basically normal to the radii of the pivot axis of the quadrant so that engagement force on surface 36' will not pivot the quadrant, but rather the force vector will be directed toward the pivot pin 38. This applies a linear shifting force on the quadrant housing 42 along the axis of the lock. The opposite ends of the pivot pin 38 extend into aligned receiving openings of trigger housing 42. Housing 42 is axially slidable within the deadbolt central opening 30*a*. It also defines an arcuate shaped recess 42' (FIG. 3) to receive the pivotal trigger when in its recessed position. In rear face 36''' is a slot shaped recess 36*a*** to accommodate the end of a tool such as a screwdriver blade or the like.

Figure 6:
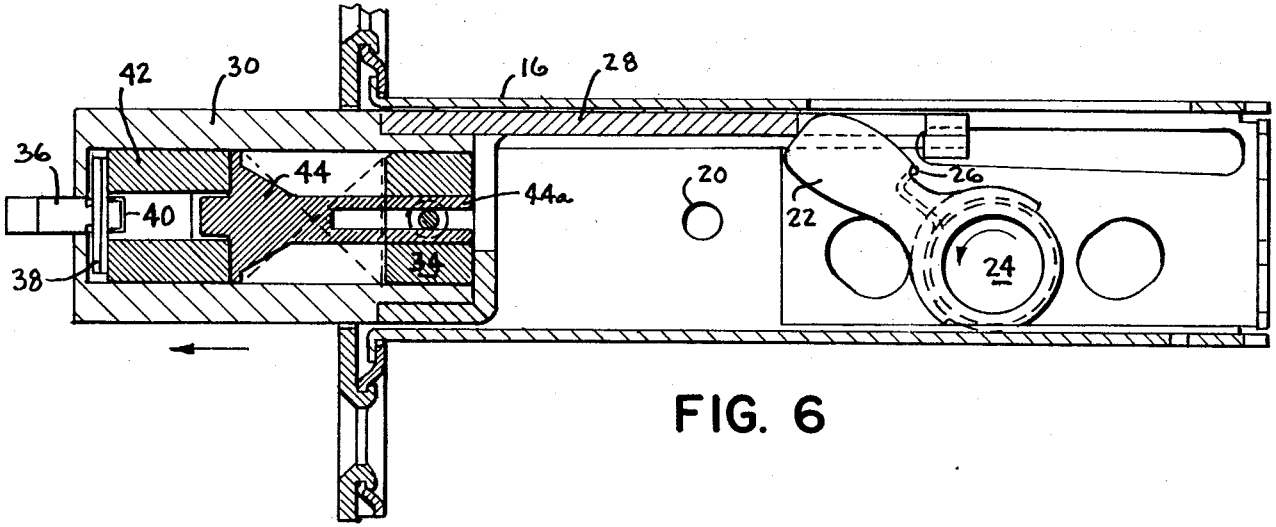
FIG. 6 is a sectional view on the same plane as FIG. 2, but with the deadbolt released into fully extended position into the door strike.

Engaging the axial inner end of trigger housing 42 is a bolt plunger 44. Plunger 44 has an annular face abutting the axial inner end of trigger housing 42, and a central nose fitting into the central opening of the trigger housing. A compression coil spring 46 applies an outward bias to plunger 44, toward the trigger housing 42. Its outer end abuts bolt plunger 44 and its inner end abuts locking pin housing 34. An inner axial shaft portion **44*a* of plunger 44 extends into and through locking pin housing 34 to form a release cam for the locking pin 48. Shaft portion 44*a* includes a diagonally tapered surface 44*b* which engages with a like diagonally shaped surface 48*b* of transversely oriented locking pin 48. Locking pin 48 is slidably received in locking pin housing 34, to be movable on its axis transversely of the elongated axis of the deadbolt, i.e. perpendicular to the extension and contraction axis of the deadbolt. The nose 48*a* of locking pin 48 extends through an opening 30*a* (FIG. 3) in the deadbolt, and selectively through an aligned opening in the lock housing 16, and specifically opening 20' in the case half 20 (FIGS. 3 & 6). In fact, locking pin 48 is biased to this extended position through both of these openings by a compression coil spring 50 which serves as an actuator spring for the locking pin. This spring has one end engaged with locking pin 48 in a recess therein, and the other end engaged with the inner wall of the deadbolt, opposite the opening 30*a*. Extension of nose 48*a* into these openings causes it to engage the peripheral shoulders of these openings to retain the inner subassembly in retracted position in the fixedlock housing. Such a shoulder on the housing can be alternatively made by an offset or the like rather than an opening. Axially inward movement of plunger 44 to cause forced engagement of surface 44*b* against tapered surface 48*b* transversely shifts locking pin 48 against the bias of spring 50 to retract its nose 48*a* from engagement with housing 16 and spepifically case half 20**, to release the deadbolt and enable the deadbolt to move independently of the fixed lock housing as described in more detail hereinafter. These components are all inside the lock housing and within the deadbolt itself.

This entire tubular lock assembly operates in cooperation with a conventional door strike 60 having a curvilinear leading edge or lip 60', and a bolt receiving opening 60''. This strike plate is mounted in conventional fashion to a door jamb (not shown) as by screws.

Figure 4:
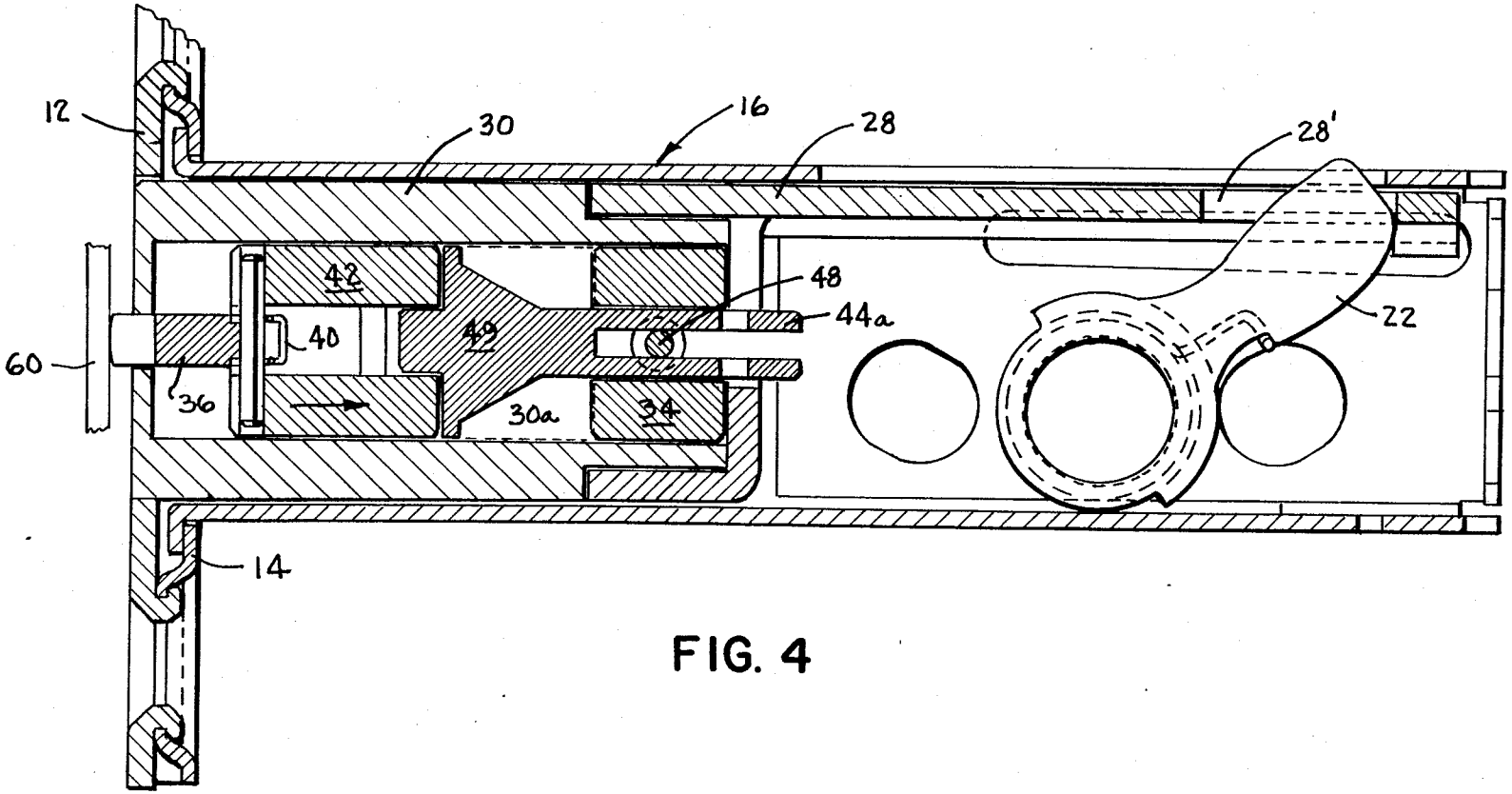
FIG. 4 is a sectional view on the same plane as FIG. 2, but with the deadbolt mechanism depressed due to engagement of the cam surface of the trigger with the door strike lip.
Figure 5:
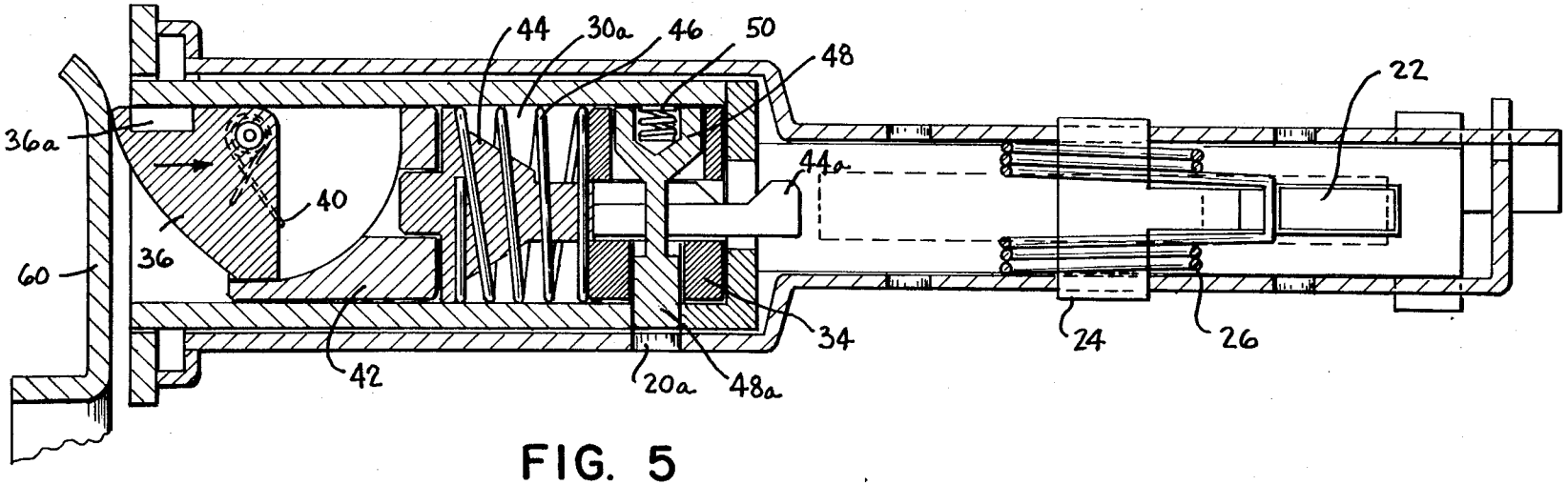
FIG. 5 is a sectional view on the same plane as FIG. 3, but with the deadbolt mechanism depressed as in FIG. 4.
Figure 7:
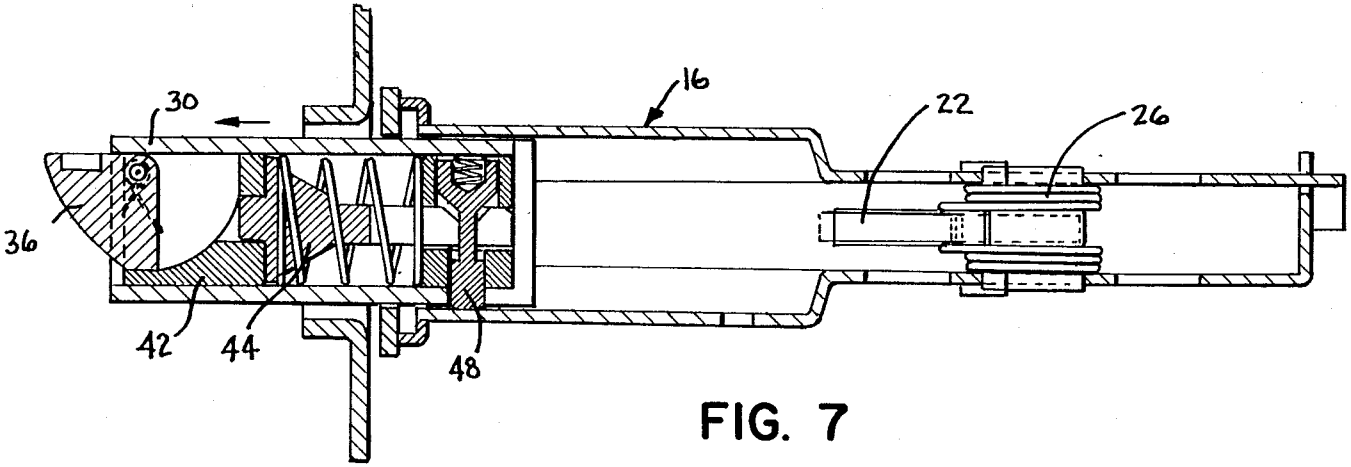
FIG. 7 is a sectional view on the same plane as FIG. 3, but with the deadbolt in the fully extended position as in FIG. 6.

As noted previously, the structure as depicted in FIGS. 1–3 shows the deadbolt in its retracted position, i.e. unlocked condition, with trigger 36 protruding from the outer end of the deadbolt. The actions that occur upon closure of the door containing the novel structure are depicted sequentially in FIGS. 2 & 3, 4 & 5, and 6 & 7. Upon closure of the door containing the deadbolt assembly, i.e. movement thereof toward strike 60 in the door jamb (FIGS. 2 & 3), the camming curved surface 36' of the trigger will first engage the lip 60' of the strike plate. Because this camming surface 36' is normal to the radii from the pivot axis of the quadrant trigger, the engagement force of these two components will not cause the trigger to pivot, but rather the force will be directed axially of the deadbolt to axially depress the elements within the deadbolt as depicted in FIGS. 4 and 5. More specifically, trigger 36 will be axially depressed along with its housing 42, thereby forcing plunger 44 axially inwardly against the compression of spring 46, the engagement of surface **44*b* and 48*b* shifting the locking pin 48 transversely against its compression spring 50, thereby retracting nose 48*a* of the locking pin from the orifice 20' of the lock housing. This releases the deadbolt assembly from the housing to allow it to move axially outwardly independently of the fixedly-mounted lock housing 16. This movement is caused by torsion spring 26. Specifically, when trigger 36 and its surrounding deadbolt align with the strike plate opening 60'', torsion spring 26 pivots swivel 22 to shift bolt body 28 and bolt 30, causing the deadbolt and its contained subassembly to move into the fully extended position through opening 60'' as depicted in FIGS. 6 and 7. This automatic deadbolt extension results in the door being locked securely simply by being closed. The deadbolt cannot then be forceably depressed back into its recessed position because of the engagement of the outer end of swivel 22 with the bolt body (FIG. 6**).

Figure 9:
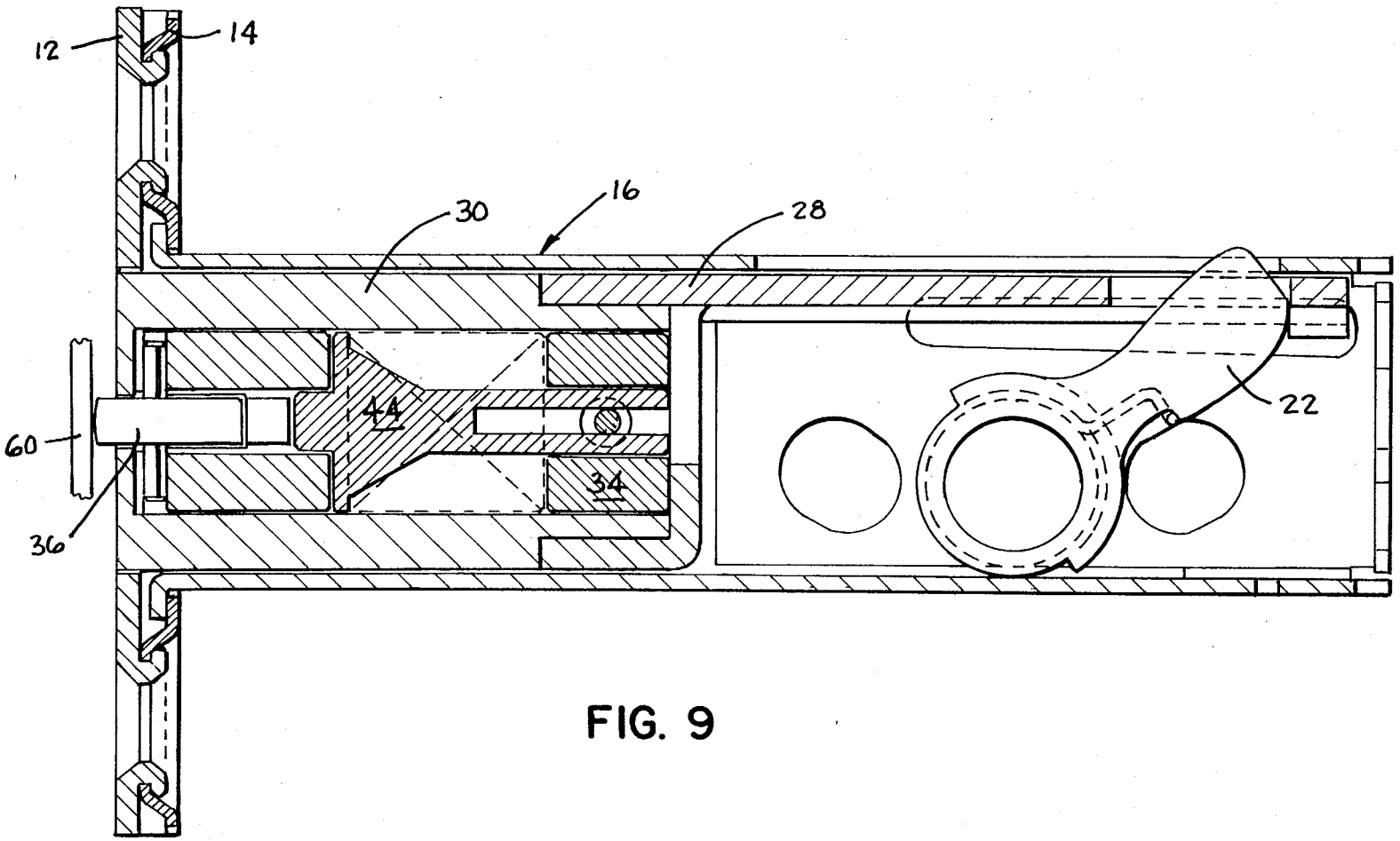
FIG. 9 is a side elevational sectional view taken on the same plane as FIG. 2 with the deadbolt retracted and the trigger pivotally shifted as in FIG. 8.
Figure 10:
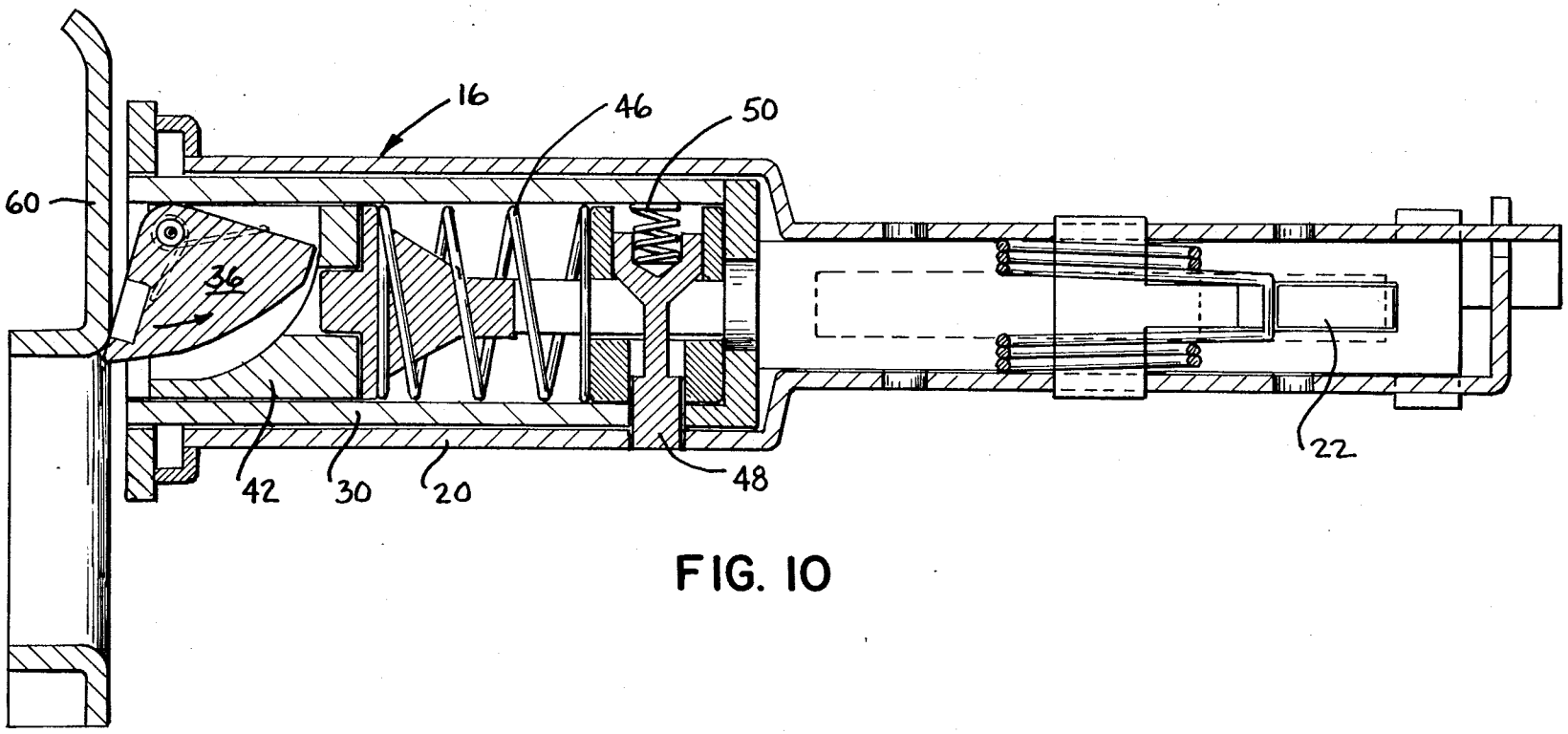
FIG. 10 is a sectional view taken on the same plane as FIG. 3 with the deadbolt retracted and the trigger pivotally shifted as in FIGS. 8 and 9.

The actions occurring upon unlocking and opening of the door containing the novel lock are depicted in FIGS. 9 and 10.

To retract the deadbolt and thereby unlock the door, the conventional key and cylinder actuator, or alternatively the thumb turn or the equivalent, is rotated, to rotate the shaft thereof. This rotates swivel sleeve 24 and thereby moves swivel 22 arcuately to its retracted position, thereby retracting bolt body 28 and deadbolt 30 along with the triggering subassembly within the deadbolt. Retraction of the bolt and bolt body is against the bias of spring 26, to cock the deadbolt. As the bolt reaches its fully retracted/cocked position, opening 30*a* lines up with opening 20′, allowing spring 50 to extend nose 48*a* of locking pin 48 into opening 30*a* to retain the deadbolt in retracted condition. At that point, with the door still closed but the deadbolt retracted, trigger 36 still extends fully from the nose of the deadbolt. With turning of the doorknob and movement of the door toward the open position, the outer rear surface 36‴0 of trigger 36 engages the edge of opening 60″ of the strike so that further movement of the door and lock assembly causes trigger 36 to pivot largely into the deadbolt as depicted in FIGS. 9 and 10, against the bias of its torsion spring 40. This pivotal action does not cause axial movement of the trigger housing and plunger 44 however, because torsion spring 40 has less bias strength than compression spring 46 so that trigger housing 42 and plunger 44 do not move. As soon as the trigger clears the lip 60′ of strike 60, it is pivoted by its torsion spring back to its protruding condition. This pivotal action of the trigger, since it does not depress the plunger with its cam, does not release the lock mechanism to cause it to extend to the locked condition as the door is opened. Hence, the deadbolt will not be extended by opening the door, but only by closing the door. The deadbolt stays in this retracted position until the door is again closed, at which time it automatically extends in the manner explained above.

The mechanism is capable of use with a left hand door as well as a right hand door. Conversion of the mechanism to accommodate left or right hand doors is readily made by a simple tool such as a screwdriver, with a simple rotative motion. More specifically, when the lock installer, for example, wishes to change the mechanism to accommodate the door motion, he simply pushes trigger 36 to depress it into the deadbolt, and with a screwdriver or the like in notch 36*a* (FIG. 10) pushes the trigger quadrant until it is behind the front nose flange 30′ of the deadbolt (i.e., a small angle more than in FIGS. 9 and 10), then rotates the trigger quadrant 36 and its trigger housing 42 for 180 degrees inside the deadbolt cavity 30*a*, until the trigger again is aligned with slot 30″, then releases the trigger to allow it to be pivoted out by its spring 40. The trigger quadrant now protrudes in the opposite direction. That is, the cam surface 36′ is now facing the opposite direction, the reverse of what it previously did. The unit is then ready for full function after this quick, simple conversion which takes only a couple of seconds.

The novel assembly can be installed in any standard door with standard borings that would normally receive a conventional deadbolt assembly. Thus, it does not require the installer to change the door borings, and does not require steel door manufacturers to alter their standard door construction. Further, it can even be retrofitted into standard doors now in existence and presently utilizing the standard deadbolt structure. This is done simply by removing the standard deadbolt and inserting this one in its place. Even the homeowner or tenant can achieve this without calling upon a locksmith or carpenter, if he so chooses.

Conceivably, certain minor variations in this special structure can be made without departing from the basic concept set forth by the preferred embodiment illustrated and explained above. The invention is therefore intended to be limited only by the scope of the appended claims and the equivalent structures, rather than by the specific preferred and illustrated embodiment.

The embodiments of the invention in which an exclusive property or privilege is claimed are defined as follows:

1. An automatic tubular lock deadbolt assembly for a door and cooperable with a strike plate on a door jamb, including an elongated tubular housing having a front face, a deadbolt in said housing movable between a retracted position and an extended lock position, and means for shifting said deadbolt from said extended position to said retracted position, the improvement comprising:

biasing means within said housing for biasing said deadbold toward said extended position, locking pin retention means in said housing for retaining said deadbolt in said retracted position and biased to move transverely toward a deadbolt securing condition, camming element release means in said housing cooperable with said locking pin retention means for shifting the locking pin transversely to release said deadbolt to allow extension thereof to said extended position, and trigger means cooperable with said release means, protruding from said deadbolt past said front face to engage the strike plate on the door jamb for actuating said release means and thereby cause said biasing means to automatically shift said deadbolt to said extended position with closure of the door.

2. The deadbolt assembly in claim 1 wherein said locking pin is engageable between said deadbolt and said tubular housing to secure said deadbolt in said retracted position.

3. The deadbolt assembly in claim 2 wherein said locking pin is releasable from engagement with said housing to allow said deadbolt to be extended.

4. The deadbolt assembly in claim 1 wherein said camming element is a tapered plunger movable toward said locking pin, and plunger biasing means for biasing said plunger away from said locking pin.

5. The automatic deadbolt assembly in claim 1 wherein said trigger means is a quadrant pivotally mounted on a pivot axis in said deadbolt and biased to protrude from said deadbolt, said quadrant being pivotally retractable against its bias into said deadbolt; and said quadrant having an arcuate camming surface on its leading edge, normal to the radii of said pivot axis, whereby engagement of said arcuate camming surface with a strike plate during door closure causes said quadrant to depress said deadbolt and release means to release said retention means and thereby enable said deadbolt to be extended, while engagement of said quadrant with the door jamb during door opening causes the quadrant to pivot on its pivot axis into said deadbolt to allow movement past the strike plate without release of said retention means.

6. The automatic deadbolt assembly in claim 5 including a trigger housing in said deadbolt pivotally mounting said trigger quadrant adjacent its apex, said trigger housing being rotatable in said deadbolt, and wherein said trigger quadrant has a rear face configured to receive a tool, whereby said trigger quadrant when recessed into said deadbolt can be rotated 180 degrees with its said trigger housing to accommodate left hand and right hand mounted doors.

7. An automatic tubular lock deadbolt assembly for a door and cooperable with a strike plate on a door jamb, including an elongated tubular housing having a front face, a deadbolt in said housing movable between a retracted position and an extended lock position, and means for shifting said deadbolt from said extended position to said retracted position, the improvement comprising:

a trigger housing within said deadbolt; a trigger quadrant pivotally mounted on a pivot axis in said trigger housing within the outer end of said deadbolt to pivot between an extended position protruding from said deadbolt outer end and a recessed position into said deadbolt; said trigger quadrant having an arcuate camming surface for engaging the strike plate on the door jamb, said camming surface being radially located relative to said pivot axis so that strike plate engagement force on said camming surface causes linear movement of said quadrant and said trigger housing axially into said deadbolt; deadbolt biasing means in said tubular housing for applying a biasing force tending to extend said deadbolt relative to said tubular housing; deadbolt retention means in said housing to retain said deadbolt from extension; release means engageable with said deadbolt retention means for releasing said retention means and thereby allowing deadbolt extension, and said release means being activated by said linear movement of said quadrant and trigger housing.

8. The automatic deadbolt assembly in claim 7 including: trigger biasing means for biasing said trigger quadrant to its protruding position; a release means biasing spring for biasing said release means and said trigger housing and said trigger quadrant away from said deadbolt retention means, and said biasing spring having a greater biasing force than said trigger biasing means whereby said trigger quadrant can be pivoted against the bias of said trigger biasing spring without actuating said release means.

9. The automatic deadbolt assembly in claim 7 wherein said quadrant has a rear radial face for engaging the strike plate with opening of the door, for pivoting said quadrant on its pivot axis into the deadbolt without moving said trigger housing and said release means.

10. The automatic deadbolt assembly in claim 9 wherein said trigger housing is rotatable in said deadbolt, and wherein said rear radial face of said quadrant has means for receiving a tool, whereby said trigger housing and said quadrant can be rotated 180 degrees in said deadbolt with such tool to accommodate either left or right hand doors.

11. The automatic deadbolt assembly in claim 7, including a swivel operatively associated with said deadbolt, and wherein said deadbolt biasing means is a torsion spring on said swivel.

12. The automatic deadbolt assembly in claim 7 wherein said retention means is a transverse locking pin biased toward a deadbolt-securing condition with said tubular housing.

13. The automatic deadbolt assembly in claim 12 wherein said locking pin is engageable between said deadbolt and said tubular housing to retain said deadbolt in its retracted position, and said release means is a camming element engageable with said locking pin to shift it transversely for release.

14. The automatic deadbolt assembly in claim 13 including a locking pin spring biasing said locking pin toward engagement with said tubular housing.

15. An automatic tubular lock deadbolt assembly for a door and cooperable with a strike plate on a door jamb, including an elongated tubular housing having a front face, a deadbolt in said housing movable between a retracted position and an extended lock position, and means for shifting said deadbolt from said extended position to said retracted position, the improvement comprising:

biasing means within said housing for biasing said deadbolt toward said extended position, retention means in said housing for retaining said deadbolt in said retracted position, release means mounted for reciprocating movement towards and away from the strike plate in said housing cooperable with said retention means for releasing said deadbolt to allow extension thereof to said extended position, and configured trigger means cooperable with said release means, protruding from said deadbolt past said front face to engage the strike plate on the door jamb to move the said release means away from the strike plate and thereby cause said biasing means to automatically shift said deadbolt to said extended position with closure of the door and upon opening of the door the trigger means protruding from the said deadbolt past said front face to engage the strike plate on the door jamb causing the trigger means to rotate without moving the release means away from the strike plate.

* * * * *